US005111953A

United States Patent [19]

Faust et al.

[11] Patent Number: 5,111,953

[45] Date of Patent: May 12, 1992

[54] SEAL SYSTEM AND METHOD FOR CONTAINERS

[75] Inventors: Michael C. Faust, North St. Paul; Keith T. Pinckney, Bloomington; Janelle K. Wong, White Bear Lake, all of Minn.

[73] Assignee: Minnesota Mining and Manufacturing Company, St. Paul, Minn.

[21] Appl. No.: 607,770

[22] Filed: Oct. 30, 1990

Related U.S. Application Data

[63] Continuation of Ser. No. 277,291, Nov. 29, 1988, abandoned.

[51] Int. Cl.[5] ..... B65D 41/02

[52] U.S. Cl. ..... 220/214; 220/359; 206/497; 206/807

[58] Field of Search ..... 206/497, 807; 220/214, 220/359

[56] References Cited

U.S. PATENT DOCUMENTS

| | | | |
|---|---|---|---|
| 3,358,902 | 12/1967 | Emmert et al. | 200/497 |
| 3,402,874 | 9/1968 | Sternau | 206/497 |
| 3,640,417 | 2/1972 | Sakurai . | |
| 3,711,961 | 1/1973 | Spiegel et al. . | |
| 3,720,343 | 3/1973 | Irish, Jr. . | |
| 3,808,702 | 5/1974 | Laessig . | |
| 3,829,348 | 8/1974 | Spiegel et al. . | |
| 3,844,861 | 10/1974 | Irish, Jr. . | |
| 3,863,837 | 2/1975 | Spiegel et al. . | |
| 3,885,667 | 5/1975 | Spiegel et al. . | |
| 3,885,671 | 5/1975 | Spiegel et al. . | |
| 3,888,067 | 6/1975 | Cross et al. . | |
| 3,891,090 | 6/1975 | Spiegel et al. . | |
| 3,927,484 | 12/1975 | Spiegel et al. . | |
| 3,997,056 | 12/1976 | Mueller | 206/497 |
| 4,009,793 | 3/1977 | Minnesinger et al. . | |
| 4,016,807 | 4/1977 | Schellenberg | 206/497 |
| 4,046,306 | 9/1977 | Cass . | |
| 4,696,394 | 9/1987 | Estkowski et al. | 206/497 |
| 4,757,595 | 7/1988 | Fraering, Jr. | 206/497 |
| 4,782,976 | 11/1988 | Kenyon . | |
| 4,813,559 | 3/1989 | Kenyon . | |

FOREIGN PATENT DOCUMENTS

| | | |
|---|---|---|
| 1394496 | 4/1972 | United Kingdom . |
| 1550428 | 3/1973 | United Kingdom . |
| 2062593A | 12/1980 | United Kingdom . |
| 2143512A | 3/1982 | United Kingdom . |

*Primary Examiner*—Joseph Man-Fu Moy
*Attorney, Agent, or Firm*—Merchant, Gould, Smith, Edell, Welter & Schmidt

[57] ABSTRACT

A sealable lid assembly and a method of using same to form a tamper evident seal for a container involves a heat shrinkable strip which is preformed on a container lid prior to assembly. The strip includes a first strip of pressure sensitive adhesive tape which is adhered to a lower rim of the container lid, and a second strip of rigid heat shrinkable material adhered to a lower portion of the first strip. The container lid is placed upon a container and heat is then applied to the shrinkable strip, which creates a tamper evident seal between the lid and the container.

6 Claims, 5 Drawing Sheets

SEAL SYSTEM AND METHOD FOR CONTAINERS

This is a continuation of application Ser. No. 07/277,291, filed Nov. 29, 1988, which was abandoned upon the filing hereof.

BACKGROUND OF THE INVENTION

1. Field of the Invention

The present invention relates to tamper evident closures, which are used to verify that a container has not been opened subsequent to its sealing. More particularly, the present invention provides a tamper evident closure for a container and system for installing, which is simple to install and can be incorporated onto an existing container assembly line at a minimum of cost.

2. Description of the Prior Art

Contemporary package designs often utilize a band of tape or other tamper evident seal around a lid of a packaged article to enable a consumer to determine whether the container may possibly have been breached or contaminated prior to use. Such tamper evident seals are particularly advantageous for use with containers for storing food stuffs or the like. An example of such a seal and an apparatus which is used to apply the seal to a container is disclosed in U.S. Pat. No. 3,873,018 to Donnay. In that system, an additional station was provided on a manufacturing line for applying a band of tape between a lid of the container and the container body after placement of the lid on the container. Thus, tamper evident seals for containers have in the past been installed on the containers in a manufacturing step that is performed separately and subsequent to assembly of the containers.

One disadvantage of such prior art systems is that the equipment required to place a tamper evident seal upon a container is relatively expensive to purchase and maintain. Moreover, such systems are relatively bulky and take up a substantial amount of space on a manufacturing floor.

It is clear that there has existed a long and unfilled need in the prior art for a system to apply a tamper evident seal to a container that is less expensive to purchase and maintain, and that does not take up a great deal of space on a production floor.

SUMMARY OF THE INVENTION

The present invention provides a sealable lid assembly of the type which is adapted to be placed upon a container to seal the container, comprising a lid adapted for fitting upon a container, the lid having a lower rim portion with an outer surface; and a strip assembly attached to the lower rim portion for shrinking when heat is applied thereto, the strip assembly extending beneath the lower rim portion, whereby the strip assembly will shrink to engage a container when the lid member is placed thereon, in order to form a tamper evident seal.

In order to form a tamper evident seal on a container in a compact, economical fashion, the present invention further comprehends a method comprising providing at least one prefabricated lid assembly including a lid member having a lower rim portion and a strip assembly attached to the lower rim portion for shrinking when heat is applied thereto; providing a container body having at least one upstanding wall defining an opening at an upper rim thereof; placing a prefabricated lid assembly on the container body so as to close the opening; and applying heat to the strip assembly so as to shrink the strip assembly about the container body, whereby a tamper evident seal is formed between the lid member and the container.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
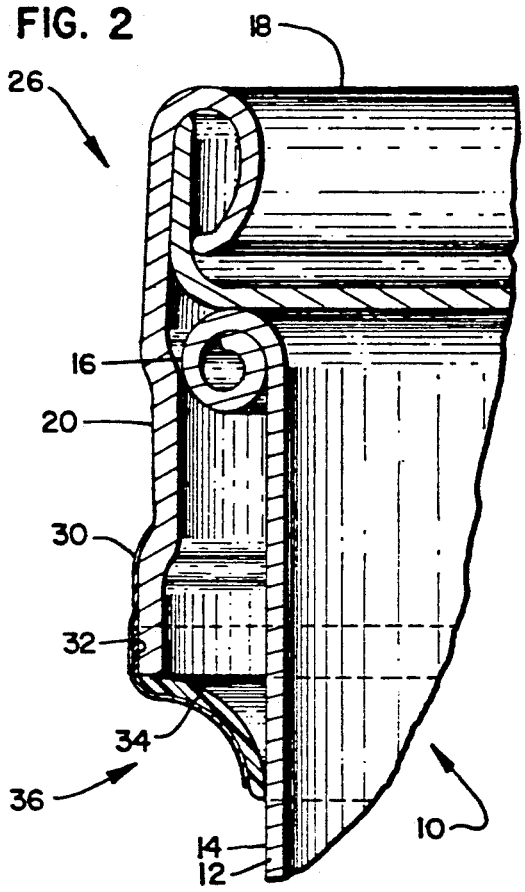
FIG. 2 is a fragmentary cross-sectional view of the embodiment illustrated in FIG. 1, with the lid assembly and container body in a sealed position.
Figure 1:
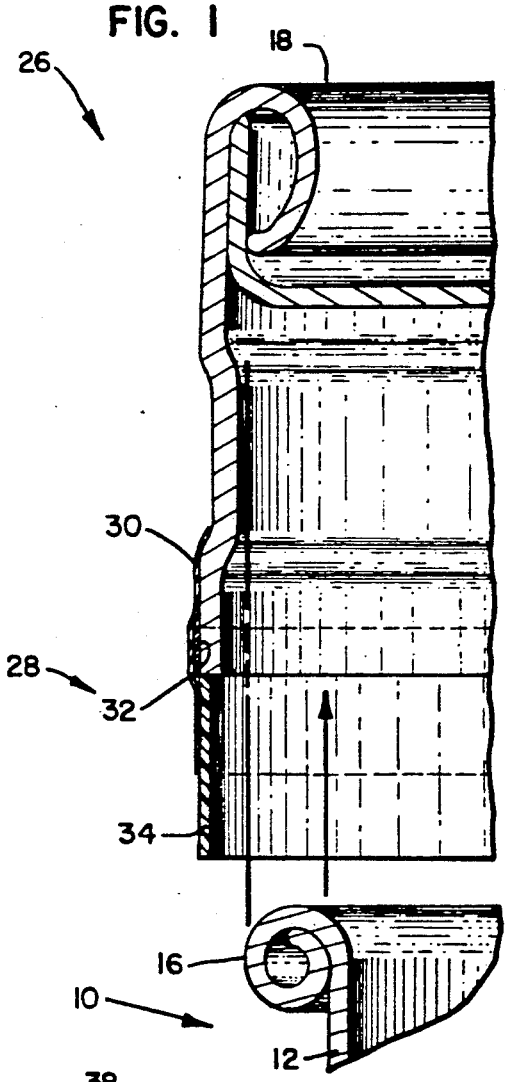
FIG. 1 is a cross-sectional fragmentary view of a container and lid assembly according to a first embodiment of the invention, shown prior to sealing.
Figure 3:
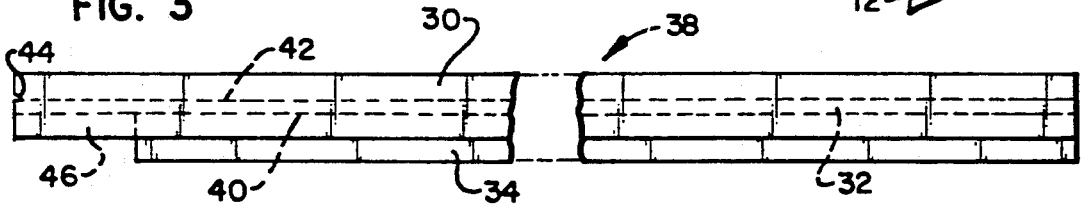
FIG. 3 is a plan view of a seal blank used in the embodiment of FIGS. 1 and 2.

Referring to the drawings, wherein like reference numerals designate corresponding structure throughout the views, and particularly referring to FIGS. 1-3, a container body 10 includes a cylindrical upstanding wall 12 which defines a circular opening in the top of container body 10. Wall 12 terminates at an upper rim bead portion 16 thereof, as is shown in FIG. 1. In the illustrated example, container body 10 is of the type which is commonly used to store ice cream or other quiescently frozen food products.

A lid member 18 is provided for sealing the circular opening in the top of container body 10. Lid member 18 includes a top surface 22, a top edge 24 and a downwardly extending cylindrical rim portion 20 having a outside surface 21, as may be seen in FIG. 2. In order to seal the opening in container body 10, lid member 18 is placed upon the container body 10 in such a way that rim portion 20 slides over the rim bead 16 and extends downwardly parallel to an outside surface 14 of container wall 12, in the position which is illustrated in FIG. 2.

In the embodiment of FIGS. 1 and 2, lid member 18 forms part of a sealable lid assembly 26 and is provided with a seal strip 28 which extends around the circumference of rim portion 20. Seal strip 28 includes a first strip 30 of pressure sensitive adhesive tape and a second portion 34. First strip 30 has an adhesive layer of synthetic rubber resin or an equivalent adhesive substance on one side thereof. First strip 30 may be a commercially available tape such as those marketed by 3M as the trademarks Scotchpro and Paklon. As is shown in FIG. 1, strip 30 has a first portion adhered to the outside surface 21 of rim portion 20, and a second portion which is adhered to a second strip of heat shrinkable film 34 which is relatively rigid with respect to first strip 30. The second strip 34 is preferably formed from a relatively rigid polymer which will shrink when heat is applied thereto, such as Glycol Modified Polyethylene Terephthalate (PETG) or Polyvinyl Chloride (PVC). In this preferred embodiment, strip 34 is preferably formed to have a thickness within the range of 7.5 to 12.5 mils. Adhered to a third portion of the adhesive surface of pressure sensitive adhesive tape 30 is a tear strip tape 32 which preferably is formed of Biaxially Oriented Polypropylene, Polyester, Tensilized Polypropylene or an equivalent material which has a relatively high tensile strength. Tear strip tape 32 may also be provided with an adhesive surface for contact with strip 30.

In order to provide a container having a tamper evident seal 36, as is illustrated in FIG. 2, the prefabricated sealable lid assembly 26 including lid 18 and seal strip 28 is lowered from the position shown in FIG. 1 to a closed position over container body 10. Heat is then applied to seal strip 28, which causes the rigid heat shrinkable film 34 to contract against the outside surface 14 of container body 10, as is shown in FIG. 2. As a result, a tamper evident seal is formed on the container body 10 without the addition of an expensive and bulky applicator machine.

FIG. 3 illustrates a seal blank 38 which may be used to form the seal strip 28 shown in the embodiment of FIGS. 1 and 2. As may be seen in FIG. 3, an edge nick 44 is formed in an end portion of first seal strip 30 adjacent the tear strip tape 32. As a result of the edge nick 44, the pressure sensitive adhesive tape 30 will tear along its interface with top edge 42 of the tear strip 32 when the tear strip 32 is pulled. Accordingly, the entire strip 34 of rigid heat shrinkable film will be removed along with tear strip tape 32 when the tamper evident seal 36 is removed by a consumer.

As is also shown in FIG. 3, strip 34 is formed shorter in length than the strip 30 of pressure sensitive adhesive tape, which exposes an area 46 of adhesive on the rear side of pressure sensitive adhesive tape 30. The area 46 of exposed adhesive is used to fasten one end of the seal blank 38 to the other during fabrication of the sealable lid assembly illustrated in FIG. 1.

Figure 4:
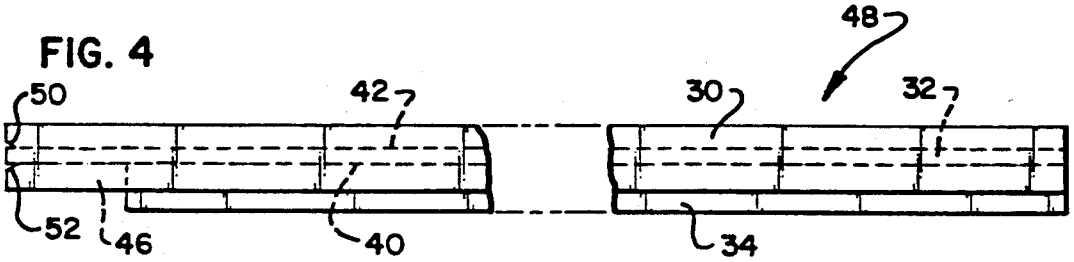
FIG. 4 is a plan view of a modified seal blank adapted for use with the embodiment of FIGS. 1 and 2.

Referring to FIG. 4, a modified seal blank 48 for use with the embodiment of FIGS. 1 and 2 has a first edge nick 50 formed on one end of pressure sensitive adhesive tape 30 above tear strip 32, and a second edge nick 52 formed in the same end of pressure sensitive adhesive tape 30 immediately below tear strip tape 32. As a result, only tear strip tape 32 will be removed from seal strip 28 when the tamper evident seal 36 is broken by consumer, thereby leaving the upper portion of pressure sensitive adhesive tape 30 and the rigid shrinkable film 34 upon the container.

Figure 6:
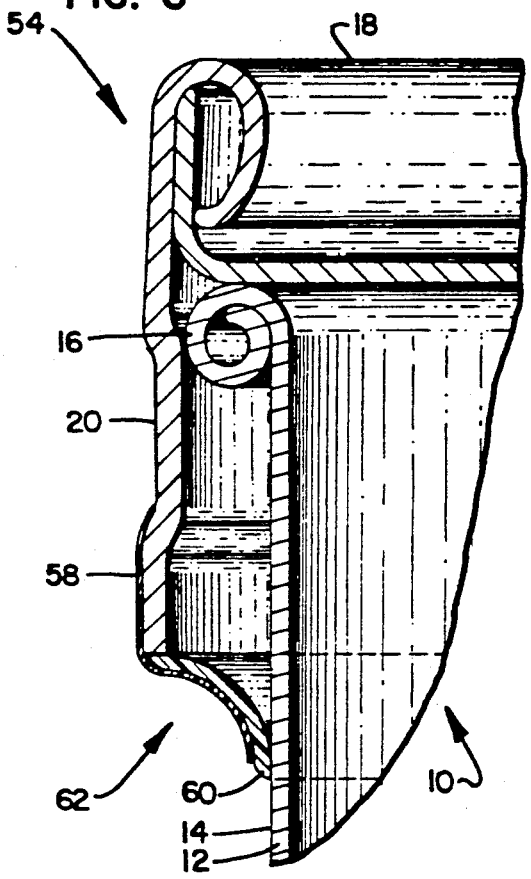
FIG. 6 is a fragmentary cross-sectional view of the embodiment illustrated in FIG. 5, shown after sealing.
Figure 5:
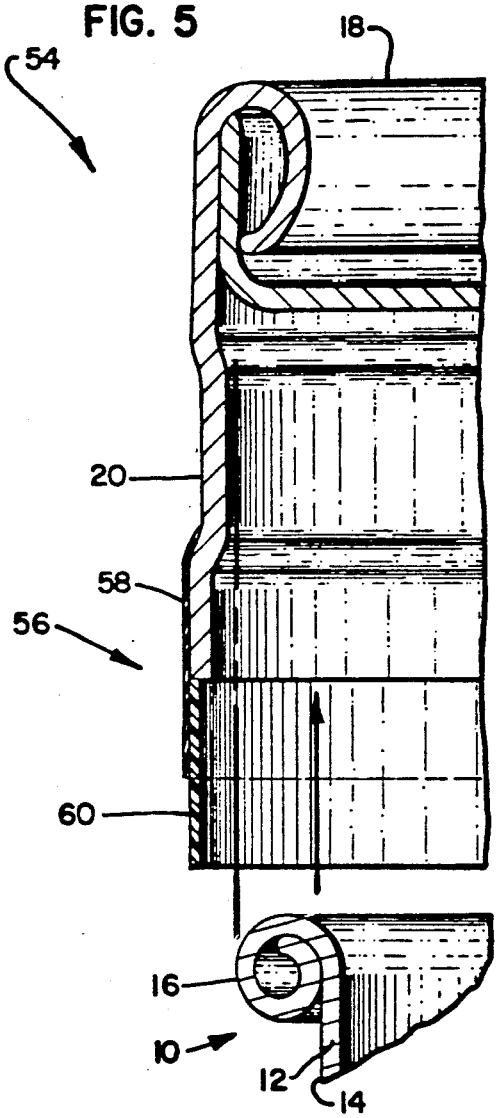
FIG. 5 is a fragmentary cross-sectional view of a second embodiment of the invention, shown prior to sealing.

A second embodiment of a sealable lid assembly according to the invention is illustrated in FIGS. 5 and 6. In this embodiment, a seal strip 56 includes a first strip of pressure sensitive adhesive tape 58 and a second strip of rigid heat shrinkable film 60. The first strip 58 of pressure sensitive adhesive tape is preferably formed from materials listed above in reference to first strip 30 in the embodiment of FIGS. 1 and 2. Accordingly, the second strip of rigid heat shrinkable film 60 is preferably formed from the materials listed above in regard to strip 34 in the embodiment of FIGS. 1 and 2. In operation, the prefabricated sealable lid assembly 54 is placed upon container body 10 in the manner described above in reference to FIGS. 1 and 2. Heat is then applied to seal strip 56, which causes seal strip 56 to contract, thereby creating a tamper evident seal 62 which bears against the outside surface 14 of the container wall.

Figure 7:
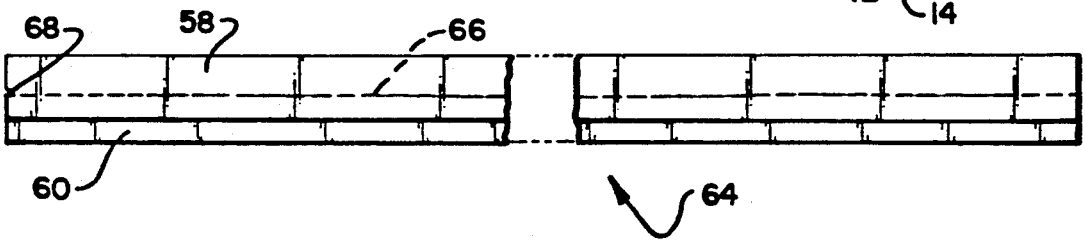
FIG. 7 is a plan view of a seal blank adapted for use with the embodiment illustrated in FIGS. 5 and 6.

Referring to FIG. 7, a sealing blank 64 is provided for forming the seal strip 56 which is illustrated in FIG. 5. As is shown in FIG. 7, an edge nick 68 is defined in the pressure sensitive adhesive tape 58 on an end portion of sealing blank 64. Edge nick 68 is defined slightly above the top edge 66 of the heat shrinkable rigid strip 60. As a result, the pressure sensitive adhesive tape 58 will tear along its interface with the top edge 66 of the rigid heat shrinkable strip 60 when the tamper evident seal 62 is being removed by a consumer.

Figure 8:
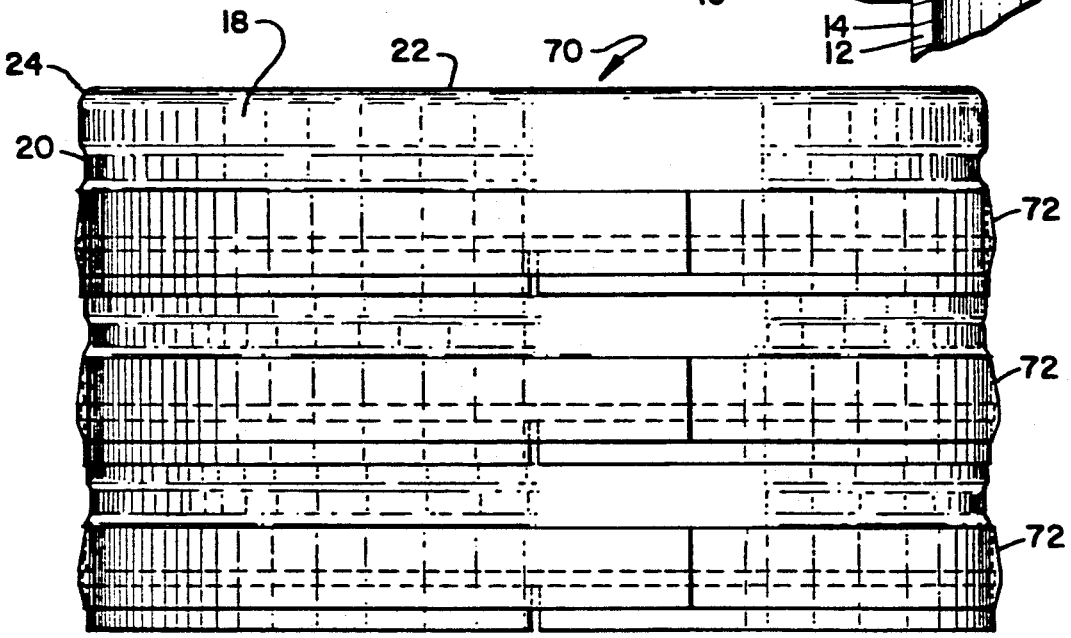
FIG. 8 is a plan view of a lid assembly constructed according to a third embodiment of the invention.

A third embodiment 70 of a sealable lid assembly according to the invention is depicted in FIG. 8. This embodiment differs from the embodiment illustrated in FIGS. 5 and 6 in that a seal strip 72 is formed so as to have a greater inside diameter than the outside surface of the rim portion 20 of lid member 18. As a result, a lid assembly constructed according to the embodiment of FIG. 8 will be stackable with respect to other lid assemblies which are similarly constructed. As is shown in FIG. 8, the flaring seal strips 72 fit comfortably over the top edge 24 of a lid member 18.

Figure 10:
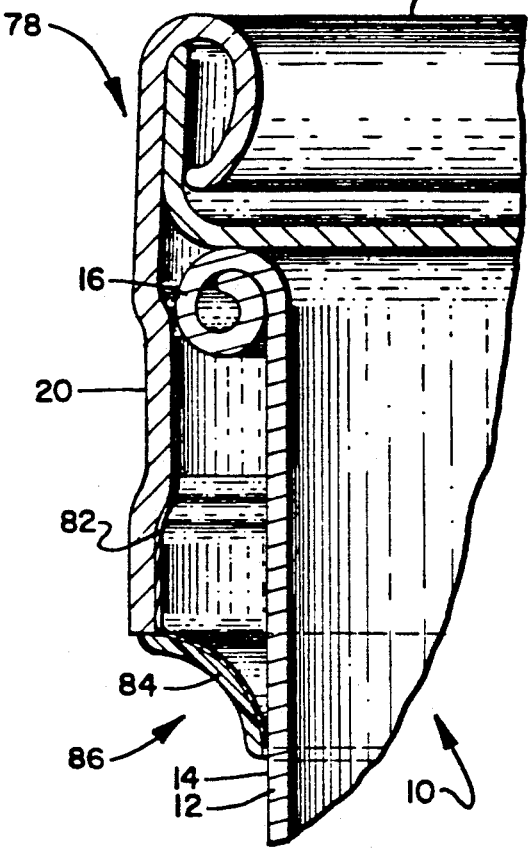
FIG. 10 is a fragmentary cross-sectional view of the embodiment illustrated in FIG. 9 shown in a sealed position.
Figure 9:
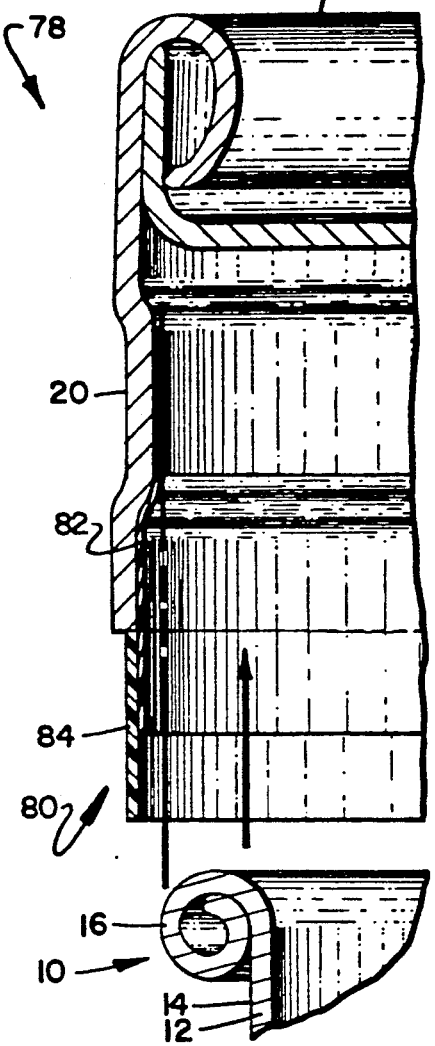
FIG. 9 is a fragmentary cross-sectional view of a container body and lid assembly constructed according to a fourth embodiment of the invention, shown prior to sealing.

Referring to FIGS. 9 and 10, a fourth embodiment 78 of the sealable lid assembly includes a first strip 82 of pressure sensitive adhesive tape which has a first portion adhered to an inside surface 23 of the rim portion 20 of lid member 18. A second strip of rigid heat shrinkable film 84 is adhered to a second portion of pressure sensitive adhesive tape 82 that extends beneath rim portion 20, as is shown in FIG. 9. In order to create a tamper evident seal 86, the prefabricated sealable lid assembly 78 is placed upon container body 10 and heat is applied to the seal strip 80. This causes the second strip of rigid, shrinkable film 84 to contract, which forces the pressure sensitive adhesive tape 82 to bear against the outside surface 14 of container body 10, as is shown in FIG. 10.

Figure 11:
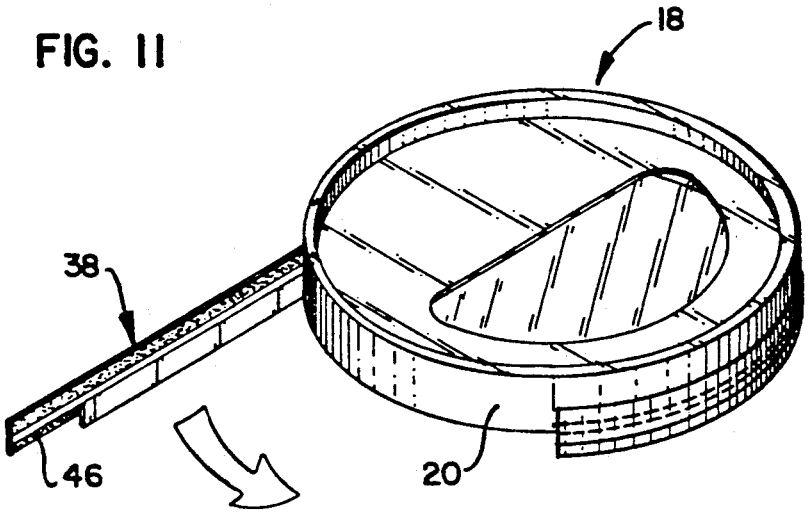
FIG. 11 is a diagrammatical view illustrating one method step according to the invention.

In order to form a prefabricated sealable lid assembly of the type described above in reference to FIGS. 1-3, a seal blank 38 is wrapped around the rim portion 20 of a lid member 18, as is shown in FIG. 11. The exposed adhesive portion 46 is then laminated onto the opposite end of seal blank 38, while the pressure sensitive adhesive tape in the seal blank 38 adheres to the rim portion 20 of the lid member 18.

Figure 12:
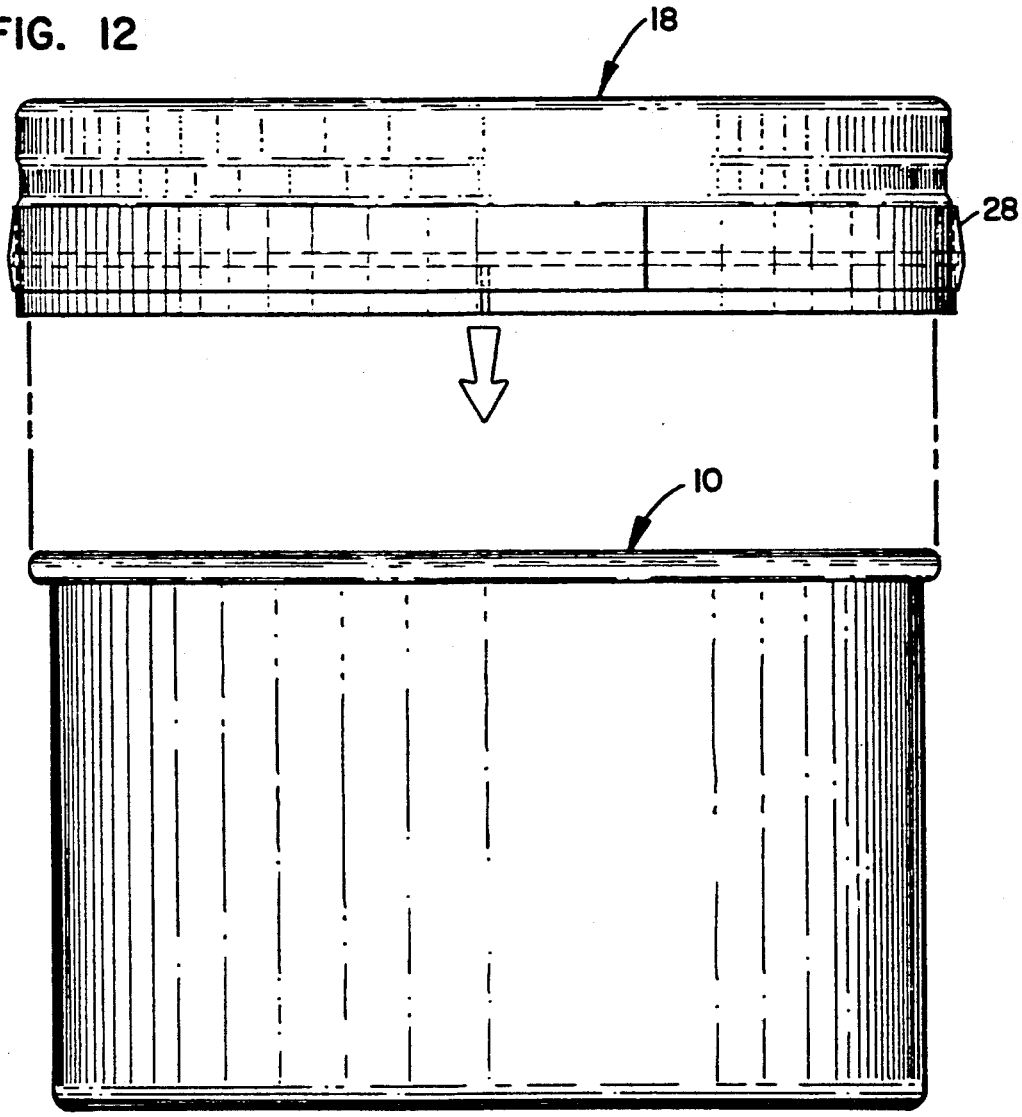
FIG. 12 is a diagrammatical view illustrating a second method step according to the invention.

As is shown in FIG. 12, the prefabricated sealable lid assembly 26 is then placed upon a container body 10 so as to seal the opening defined by the upper rim of the container wall, to form a presealing container assembly 94.

Figure 13:
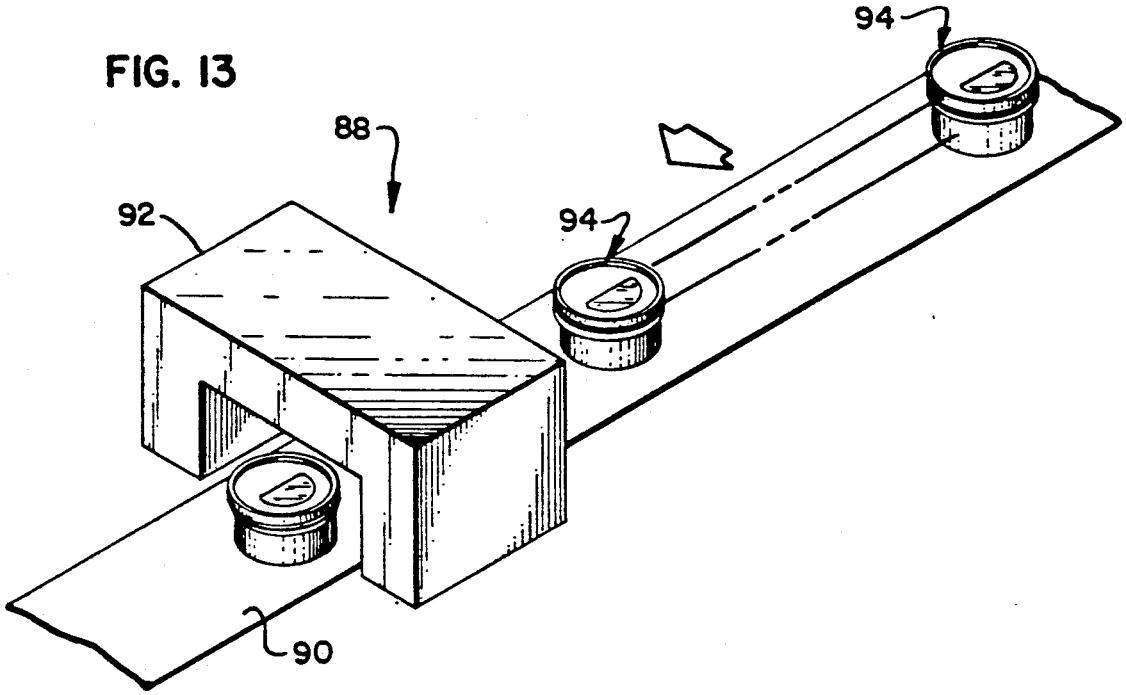
FIG. 13 is a diagrammatical view illustrating a third method step according to the invention.

The presealing container assemblies 94 are then passed through a shrinking station 88 which in the preferred embodiment includes an endless conveyor belt 90 and a heat tunnel 92, as is shown in FIG. 13. Heat tunnel 92 preferably heats the strips on the containers to a temperature of 220°-250° F. in the preferred embodiment wherein the thickness and material of the strips are as stated above. The container assemblies 94 are passed through heat tunnel 92, thereby forming the tamper evident seal 36 between the lid member and container body of the container. Although the process illustrated in FIGS. 11-13 has been described with reference to the embodiment shown in FIGS. 1 and 2, it should be understood that the process is applicable to any of the embodiments disclosed herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A prefabricated sealable lid assembly of the type which is adapted to be placed upon a container to seal said container comprising:

lid means for fitting upon said container, said lid means having an annular rim, said annular rim having an outer circumferential surface and an inner circumferential surface;

heat shrink strip means, having a length substantially equal to the circumference of said outer circumferential surface of said lid means, said heat shrink strip forming a substantially cylindrical seal ring, having an inner circumferential surface and an outer circumferential surface, and having an upper edge, and a lower edge, said upper edge abutting said annular rim, and said ring extending from, projecting below, and not overlapping said annular rim, for tamper evident sealing of said container;

adhesive band means for attaching said heat shrink means to said lid means, having a length substantially equal to the circumference of said outer circumferential surface of said lid means, said adhesive band means having an attachment surface having adhesive thereon, said attachment surface divided into a first, lid means attachment portion, and divided into a second, heat shrink strip means attachment portion, said first lid means attachment portion coupled to said outer circumferential surface of said lid means, said second heat shrink means attachment portion coupled to said outer circumferential surface of said heat shrink strip means;

whereby, said heat shrink strip means will shrink to engage said container forming a tamper evident seal, when heat is applied to said heat shrink strip means.

2. The prefabricated sealable lid assembly of claim 1 further comprising:

edge nick means, formed in said adhesive band means, said tear strip having an upper edge and having a lower edge, said lower edge proximate said upper edge of said heat shrink strip means, for facilitating splitting of said adhesive band and removal of said heat shrink means from said container.

3. The prefabricated sealable lid assembly of claim 1 further comprising:

tear strip means, substantially coextensive in length with said adhesive band means, located on said outer circumferential surface of said lid rim under said adhesive band means, said tear strip means having an upper edge and a lower edge, said lower tear strip edge adjacent said upper edge of said heat shrink strip means, for splitting said adhesive band.

4. The prefabricated sealable lid assembly of claim 1 further comprising:

tear strip means, substantially coextensive in length with said adhesive band and shorter in length than said heat shrink strip means, said tear strip means located on said outer circumferential surface of said lid rim under said adhesive band means, adjacent said upper edge of said heat shrink strip means, for splitting said adhesive band;

first edge nick means formed in said adhesive band proximate said upper edge of said tear strip means for facilitating splitting of said adhesive strip means, and removal of said heat shrink strip means from said container.

5. The prefabricated sealable lid assembly of claim 4 further comprising:

second edge nick formed in said adhesive band proximate said lower edge of said tear strip means for facilitating splitting of said adhesive strip means, and retention of a portion of said heat shrink strip means on said container.

6. A prefabricated sealable lid assembly of the type which is adapted to be placed upon a container to seal said container comprising:

lid means adapted for fitting upon a container, said lid having an annular rim, said annular rim having an outer circumferential surface and an inner circumferential surface;

heat shrink strip means having a length substantially equal to the circumference of said inner circumferential surface of said lid means, said heat shrink strip means forming a substantially cylindrical seal ring, having an inner circumferential surface and outer circumferential surface and, having an upper edge and a lower edge, said upper edge abutting said annular rim, and said ring extending from, projecting below, and not overlapping said annular rim, for tamper evident sealing of said container;

adhesive band means having a length substantially equal to the circumference of said inner circumferential surface of said lid means, said adhesive band means having an attachment surface having adhesive thereon, said attachment surface divided into a first lid means attachment portion, and divided into a second heat shrink strip means attachment portion, said first rim attachment portion coupled to said inner circumferential surface of said lid means, said second heat shrink attachment portion coupled to said inner circumferential surface of said heat shrink seal means;

whereby, said heat shrink strip means will shrink to engage said container forming a tamper evident seal, when heat is applied to said heat shrink strip means.

* * * * *